United States Patent [19]

Gehring et al.

[11] Patent Number: 4,785,856

[45] Date of Patent: Nov. 22, 1988

[54] APPARATUS FOR PRESENTING WEFT THREADS TO A GRIPPER IN SHUTTLELESS LOOMS

[75] Inventors: Fritz Gehring, Lindau-Bodolz; Valentin Krumm, Hergensweiler; Siegbert Gsell, Wangen; Walter Lindenmueller, Lindau, all of Fed. Rep. of Germany

[73] Assignee: Lindauer Dornier Gesellschaft mbH, Lindau/Bodensee, Fed. Rep. of Germany

[21] Appl. No.: 54,404

[22] Filed: May 26, 1987

[30] Foreign Application Priority Data

May 31, 1986 [DE] Fed. Rep. of Germany ..... 3618445

[51] Int. Cl.[4] ..... D03D 47/38

[52] U.S. Cl. ..... 139/453

[58] Field of Search ..... 139/452, 453

[56] References Cited

U.S. PATENT DOCUMENTS

| | | | |
|---|---|---|---|
| 4,076,054 | 2/1978 | Merisio | 139/453 |
| 4,160,468 | 7/1979 | Camprubi | 139/453 |
| 4,406,312 | 9/1983 | Egbers et al. | 139/453 |
| 4,556,089 | 12/1985 | Juillard | 139/453 |

FOREIGN PATENT DOCUMENTS 3042053 11/1982 Fed. Rep. of Germany .

*Primary Examiner*—Henry S. Jaudon

*Attorney, Agent, or Firm*—W. G. Fasse; D. H. Kane, Jr.

[57] ABSTRACT

Weft threads are presented to a gripper in shuttleless looms by needles, each guided by at least one straight guide held askew in a needle guide carrier (9). These straight needle guides due to their askew arrangement make sure that all needles together are located in and displaceable in a fan type plane twisted in space. In the working position for presenting a weft thread each needle eye is located on a short line (7) extending approximately in parallel to a gripper path. Thus, all weft threads in their presenting position are close to each other in a narrow presenting zone within the reach of the gripper path for a sure gripping at the beginning of the forward gripper motion. At its beginning the gripper speed is still slow so that the weft threads are gripped gently. The straight needle guides held askew in the at least one guide carrier (9) form a row of guides which is slanted by a given angle relative to the gripper path to form the fan type plane twisted in space. A second row of askew straight guides may be arranged in a second guide carrier (10).

9 Claims, 8 Drawing Sheets

APPARATUS FOR PRESENTING WEFT THREADS TO A GRIPPER IN SHUTTLELESS LOOMS

FIELD OF THE INVENTION

The invention relates to an apparatus for presenting weft threads to a gripper in shuttleless looms. The gripper may receive the threads in a predetermined sequence.

DESCRIPTION OF THE PRIOR ART

The weft threads in a shuttleless loom are pulled off from large supply spools. A thread selector device picks each weft thread in accordance with a control function, for example with regard to color or thread type. The thread selector device controls thread presenting needles of which the selected needle presents its thread to the gripper of a thread inserting device which carries the thread into the loom shed. The weft thread presenting needles with their respective thread guiding eyes form the thread presenting apparatus. These needles are movable back and forth between a work position and a rest position in response to a control by the thread selector device, whereby the respective thread guiding eye is moved into a zone where the thread can be picked up by the gripper of the thread inserting device.

Different versions of such thread presenting devices are known in the art. For example, the thread presenting needles may be moved along a straight path or they may be moved on a path other than a straight path. In the present context only devices with a straight needle path are of interest.

German Pat. No. (DE-PS) 3,042,053 describes a thread presenting device with, for example, eight thread presenting needles moving in parallel to each other. These eight needles form a thread fan in which the threads extend from the respective needle eye to the beat-up point or binding point at the edge of the fabric. Each of the threads follows a different path, whereby each thread end resulting after cutting, has a different length. Additionally, the inserting device, such as a gripper, seizes the respective threads at different points along its forward move which also contributes to thread ends of different lengths. These thread ends of different length later protrude from the fabric selvage and adversely affect the looks of the fabric. These weft thread ends must be cut-off and constitute waste that should be minimized.

The device of German Pat. No. 3,042,053 has a special weft thread clamp for reducing weft thread waste. This clamp is primarily displaceable in the zone of the weft thread presenting device in parallel to the weft thread insertion direction and seizes the selected weft thread to bring it into a defined position. Such a weft thread clamp with its control mechanism involves an undesirable effort and expense. Besides, especially in connection with fine, sensitive weft threads the clamp can form permanent clamping marks on the weft thread which adversely influence the looks of the finished fabric. The weft thread clamp is useful only for the type of thread for which it is made. Different thread types require different types of clamps. Additionally, the clamp is a source for soiling the weft thread.

Yet another known type of weft thread presentation involves the so-called "point presentation" in which the movable thread presenting needles are held in a fan-type configuration. The needle eyes guiding the weft thread always come to the same position or "point" in their working location. This feature of the prior art prevents the formation of a wide fan of weft threads and the presented weft thread is always seized by the insertion member at the same point. Thus, it is possible to reduce the stroke length of the thread insertion member, for example, the stroke of the gripper. Such reduced stroke length has the advantage that the thread transfer speed during the thread presentation may be reduced. As a result, the rated machine width or the useful fabric width can be increased by the length by which the gripper stroke is reduced.

Thread presenting devices which move each needle with its eye into the same working position or point have the disadvantage that the needle tips may interfere with each other in the point end of the fan configuration. In fact, the needle tips may even damage each other. These difficulties may also occur when the loom is being set-up. During set-up it may be required that all colors, or rather all weft threads must be presented simultaneously or at least several of the threads must be presented simultaneously. In order to avoid these difficulties, it is known to make the thread presenting needles of an elastic material so that the needle tips can yield. However, due to this elasticity of the needles it is necessary to provide a straight guide for each of the thread presenting needles. Such straight guide must be as long as possible.

Such long needle straight guides are necessary to avoid that the needles begin vibrating. Needle vibrations are caused particularly in connection with the insertion of rough yarns into the loom shed when these yarns are pulled through the needle eye. Further, the presence of long needle straight guides adversely affects the field of view of the operator which may result in the threading of the wrong thread through a needle eye. Further, the presence of the long needle straight guides slows down the threading of the weft threads through the needle eyes, for example, when the weft thread breaks and it becomes necessary for the operator to rethread the broken weft thread through the needle eye.

Another disadvantage of the point type weft thread presentation is seen in that it becomes impossible to simultaneously present two separate threads, for example, having different colors. In other words, the double insertion of two threads simultaneously into the loom shed is not possible with such a system. Further, due to the large slanted position of the first thread presenting needle it is impossible for the first needle to present its weft thread in a taut condition. Rather, initially, the respective first weft thread is loose and only as the needle begins to move, will the thread be slightly tightened. This loosening of the weft thread, especially the first weft thread, may cause presentation errors, especially in connection with non-elastic threads or yarns, whereby it is possible that the weft thread is not seized at all by the gripper.

Yet another disadvantage of the "point" type thread presentation is seen in that the threads are unevenly distributed in the thread fan configuration, whereby the thread division or thread pitch becomes disadvantageous, especially where, for example eight weft threads are used. Depending on the particular combination of selected weft thread presentation needles, and depending on the different types of yarns involved, it is possible that so-called "back stabbing" may occur, whereby one weft thread becomes located behind another weft thread rather than next to it in the plane defined by the fabric being woven.

The same considerations apply when the thread presentation position is not exactly a well defined point, that is, if the working positions of the individual needles are slightly different from one another so that all the working positions are located in line one next to the other. The fan-type thread distribution does not prevent the above mentioned disadvantages or, the disadvantages can be reduced only to a very limited extent. The advantages of the thread seizing in a single point and the resulting increased useful machine width, are thus again lost to a substantial extent by the mentioned disadvantages.

It has been found that for high speed looms it is very significant that the thread transfer takes place at a point where the speed of the inserting member such as the gripper, is as low as possible. The larger the gripper speed at the point of transfer, the larger is the stress to which the thread is exposed. Such stress should be avoided or at least reduced.

OBJECTS OF THE INVENTION

In view of the foregoing it is the aim of the invention to achieve the following objects singly or in combination:

to provide a thread presentation device with needles displaceable along a straight guide path which divice provides all the advantages of a point type thread presentation while simultaneously avoiding the mentioned drawbacks;

to locate the needles, especially the needle eyes in such a way that they are easily accessible and visible for the operator, for example, for the purpose of rethreading;

to avoid the mentioned back stabbing;

to provide the thread seizing at the point where the gripper has its lowest speed or almost its lowest speed;

to avoid the use of elastic needles and thus to minimize needle vibrations without the need for long straight guides;

to provide for the possibility of simultaneously inserting two or more weft threads; and to provide a thread presentation device capable of handling all types of yarns, such as very rough yarns and very thin, fine, or smooth yarns.

SUMMARY OF THE INVENTION

The weft thread presenting device according to the invention comprises at least one needle guide carrier or locator which carries or locates one needle guide for permitting a guided straight movement of each needle and which is arranged at a slant to the path of the weft thread inserting member so that the carrier or locator points toward the heald shafts of the loom. Further, the needle guides permitting the straight needle movement are each slanted in the needle guide carrier or locator so that the longitudinal axes of the needle guides have a skew in space relative to each other in such a way that the respective thread presenting needles are located and guided in a fan-type plane twisted or curved in space in which each needle is displaceable along a straight path so that the individual needle eyes assume thread presenting positions, all of which are tightly located next to each other along a line extending next to and in parallel to the weft thread insertion member or in parallel to the gripper path or approximately in parallel to the gripper path.

Due to the slant of the needle guide carrier relative to the gripper path, the overview over all the needles, including the needle eyes, has been substantially improved for the operator. Even more important, this arrangement of the needles provides access space for the rethreading operation. Replacing the plane fan-type arrangement of the prior art by a fan-type arrangement which is curved or twisted in space, the invention makes possible thread presentation positions located along a straight line extending approximately in parallel to the gripper path, whereby all thread presenting positions are tightly close to each other. This type of fan configuration twisted or curved in space also assures a good guiding of the thread presenting needles so that the use of elastically bendable thread presenting needles is not necessary any more.

According to the invention the thread presenting and transfer conditions have been improved for all types of colors and for all types of yarns so that even if complicated color changes are required for a particular weaving operation, the above mentioned "back stabbing" has been avoided. All the threads now have the same presentation, transfer, and seizing conditions. It is now possible to make double insertions, not only by seizing threads from two directly neighboring needles, but also by seizing threads from presenting needles which are somewhat spaced from each other. For example, the needle combination of needle number 1 with needle number 3 or needle number 2 with needle number 5 is now possible without difficulties. Very rough or coarse yarns can be handled just as well as thin and smooth yarns.

According to the invention, the presenting position for the first thread and for the last thread, are so closely located to each other that the gripper stroke for the thread transfer and seizing can be comparably as small as in the situation where each of the needle eyes moves to the same transfer point. Thus, the invention achieves the same advantages as the conventional "point" presentation, but without its disadvantages. As a result, the drawing-in zone of the loom can be correspondingly increased. However, the most important advantage of the invention is seen in that the thread seizing by the gripper takes place when the gripper has a substantially smaller speed than is the case in the prior art. Thus, the danger of tearing threads is substantially reduced and so are the effects of a thread clamp which the invention avoids altogether. The advantage of a thread transfer at a low gripper moving speed can be used to operate the loom at higher operational speeds. Additionally, due to the slower thread transfer, it is possible to reduce the gripping force of the insertion grippers which take over the thread, by 20 to 30% as compared to gripping forces effective on the thread in the prior art devices. This feature not only treats the threads gently, it also subjects the structural components participating in the thread transfer, in the gripping, and in the clamping to a smaller stress and thus to a smaller wear and tear so that such components as clamping levers, control or guide rails, and so forth, will have a longer useful life as compared to the same components in prior art looms.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
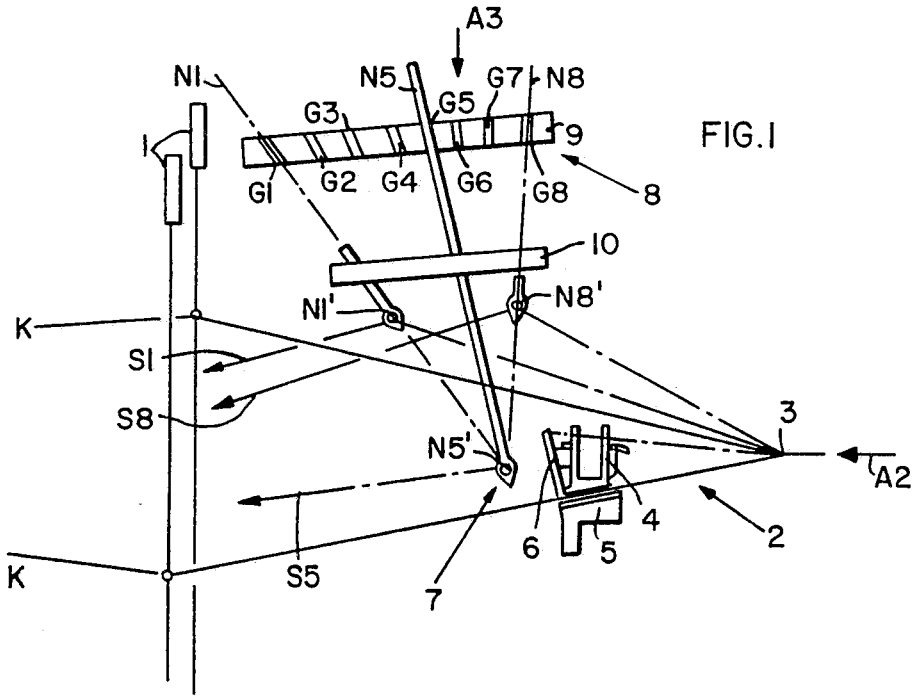
FIG. 1 is a simplified view in the direction of the arrow A1 shown in FIG. 2, representing the movement direction of a thread inserting member as it moves toward the loom shed.
Figure 2:
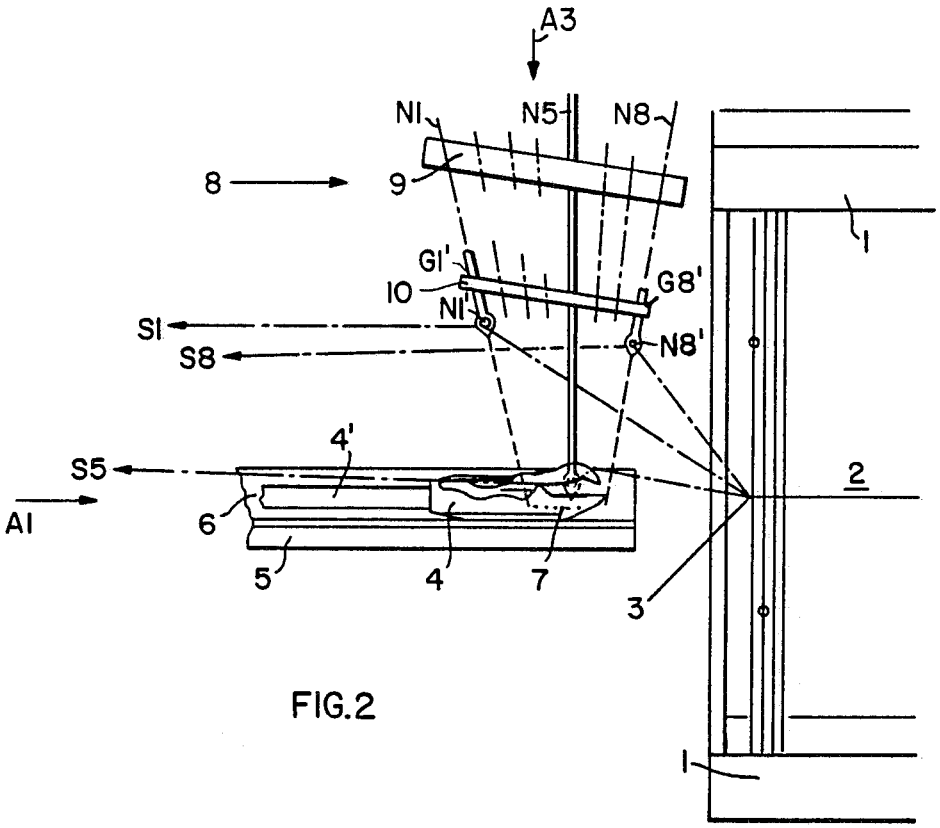
FIG. 2 is a view in the direction of the arrow A2 in FIG. 1.
Figure 3:
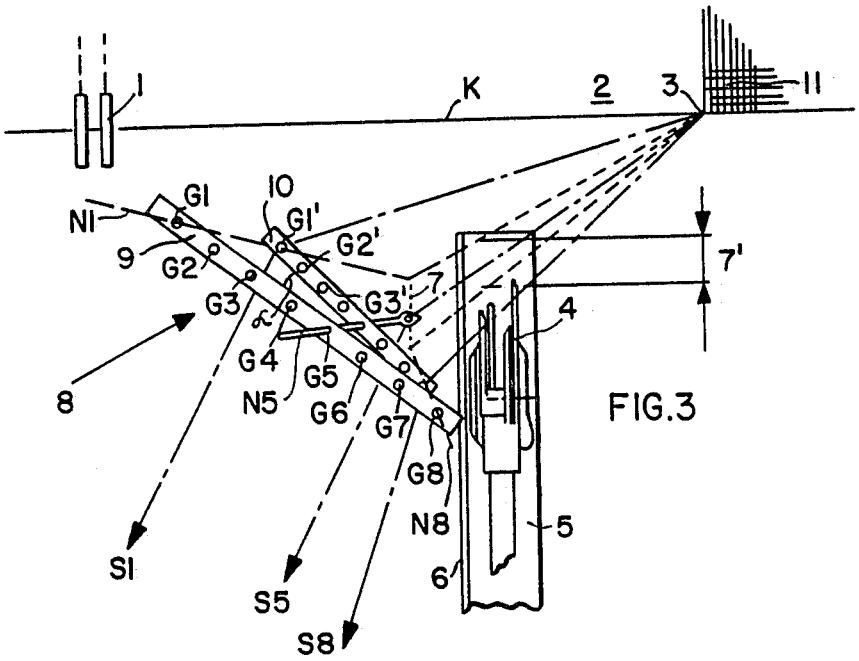
FIG. 3 is a view in the direction of the arrow A3 as shown in FIGS. 1 and 2.

Referring to FIGS. 1, 2, and 3, the basic arrangement of the present thread presenting apparatus or device will be described. The illustration of loom components not necessary for the understanding of the present invention is minimized for simplicity's sake. The illustration of the loom shed with its warp threads K passing through the heald eyes in the heddles of heald shafts 1 is sufficient to show the relative location of the present weft thread presenting device relative to the loom. The beating-up location 3 denotes the entrance into the loom shed 2.

A weft thread inserting mechanism includes a gripper head 4 attached to a gripper rod 4' and guided on a guide track 5 having a thread contact rail 6. The drive and operating means for the gripper head 4 are not shown since they are conventional. The gripper head 4 seizes any one or a group of the weft threads $S_7$ to $S_8$ for insertion into the loom shed 2.

Figure 8:
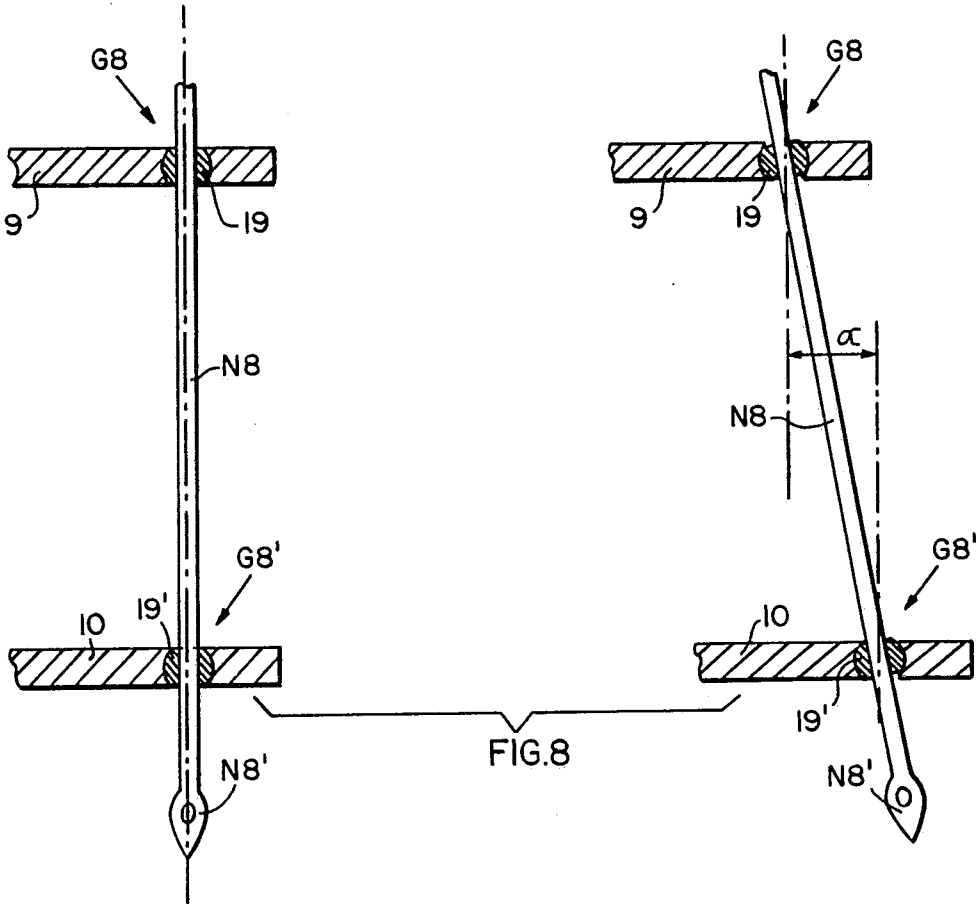
FIG. 8 illustrates a mechanism for adjusting the individual slant or skew of the needle guides in the individual guide holders.

The weft thread presenting device 8 according to the invention comprises primarily a first needle guide carrier 9 equipped with eight needle guides G1, G2 . . . G8. All needle guides may simply be guide holes in the respective guide carrier or they may be of a construction as shown in FIG. 8 for one pair of needle guides G8, G8' shown in two different adjusted positions to be described in more detail below. Each needle guide itself is straight, but its longitudinal axis may be located at a slant so that the respective needle guide G1 . . . is located at the same slant relative to the respective needle guide carrier 9. The present weft thread presenting device 8 further comprises a second needle guide carrier 10 also equipped with individual needle guides G1', G2'. . . G8' also as shown in FIG. 8. Each of the eight weft threads has its own needle N1 to N8. The two outer threads with their respective needles N1 and N8 are shown by dash-dotted lines. The middle thread presenting needle N5 is shown in full lines. Each needle N1 to N8 has a needle eye N1' to N8' at its lower end. The respective weft threads S1 to S8 are threaded through these needle eyes. Each needle, for example, the needle N5 transports its respective weft thread S5 downwardly into the thread presenting position as shown, for example, in FIG. 1. The gripper head 4 grips or seizes the presented weft thread S5 which extends through the respective needle eye and over the edge of the rail 6 of the guide track 5 of the gripper 4 to the beating-up point or edge 3. The woven fabric 11 is shown in FIG. 3 which illustrates the relative location of the present thread presenting device. The needle guide carriers 9 and 10 and the individual needle guides G1 to G8 as well as G1' to G8' no longer extend in a plane parallel to the path of the gripper head 4. Rather, according to the invention, the individual guides and the guide holders extend with a slant or skew relative to the gripper path direction, whereby the guide carriers 9 and 10 point toward the heald shafts 1. The longitudinal axis of the carrier 9 encloses an angle $\alpha$ with the longitudinal axis of the carrier 10 in FIG. 3. in the device according to the invention the needle movement does not take place in a flat plane, but rather in a fan-type surface or plane which is twisted or curved in space. The angle $\alpha$ or rather the angular adjustment of the position of the carrier 9 relative to the carrier 10 and relative to the direction of the gripper path determine the degree of the twist or skew of the fan formed by the thread presenting needles in space.

As shown in FIG. 3, this twist or skew is so selected that all eight thread presenting positions of all eight needles N1 to N8 are located on a straight line 7 extending substantially in parallel to the path of the gripper 4. The line 7 is illustrated in FIGS. 2 and 3 by dots. The threads 51 to 58 run from the needle eyes over the edge of the rail 6 of the guide track 5 to the beating-up edge 3 as mentioned above.

FIG. 3 also illustrates the position of all weft threads S1 to S8 because the position of the two outer weft threads S1 and S8 is indicated by dash-dotted lines. The threads themselves form a plane fan, whereby the path of the gripper 4 intersects the thread fan. The spacing 7' designates a distance between the intersection of the gripper path with the first thread S1 and the last thread S8 respectively. The distance 7' is smaller than the length of the straight line 7. During the thread presenting phase of the operation, the gripper is in its direction reversing phase outside the loom shed 2 close behind the presented weft threads. Thus, the gripper head has only a low speed at the beginning of its forward movement, whereby the stress applied to the thread when the gripper head seizes the thread, is substantially reduced according to the invention. In the area of the line 7' it is quite possible that two or more threads are presented for simultaneous seizing by the gripper head 4, whereby it is, for example, possible to insert so-called double wefts into the loom shed 2. It has been found that even if a plurality of needles present their threads simultaneously, they do not interfere with or hinder each other, nor do they damage each other. There is also no back stabbing and elastic needles are no longer required. Due to the position of the guide carriers 9 and 10, so that they point toward the heald shafts 1, or rather by varying the positions of the guide carriers 9 and 10, it is possible to determine the degree of twist in the curved surface formed by the presenting needles N1 to N8 in the space between the guide carriers 9 and 10. Additionally, this feature improves the visibility of the needle eyes for the operator, whereby the rethreading of any one of the weft threads into its needle eye is facilitated. Another advantage of this twisting of the plane in which the presenting needles are located in space is seen in that nevertheless the needle eyes are aligned in a very close spacing relative to each other along a straight line 7. This feature of the invention assures a certain and yet gentle seizing of the weft threads to be inserted into the loom shed 2 by the gripper head 4. As a result of this gentle treatment, it is possible to reduce the gripping force of the gripper clamps of the gripper head 4 substantially. Another advantage of the arrangement according to the invention is seen in that the weft threads have a much lesser tendency to cling to each other so that the danger of so-called back stabbing is substantially reduced.

Figure 4:
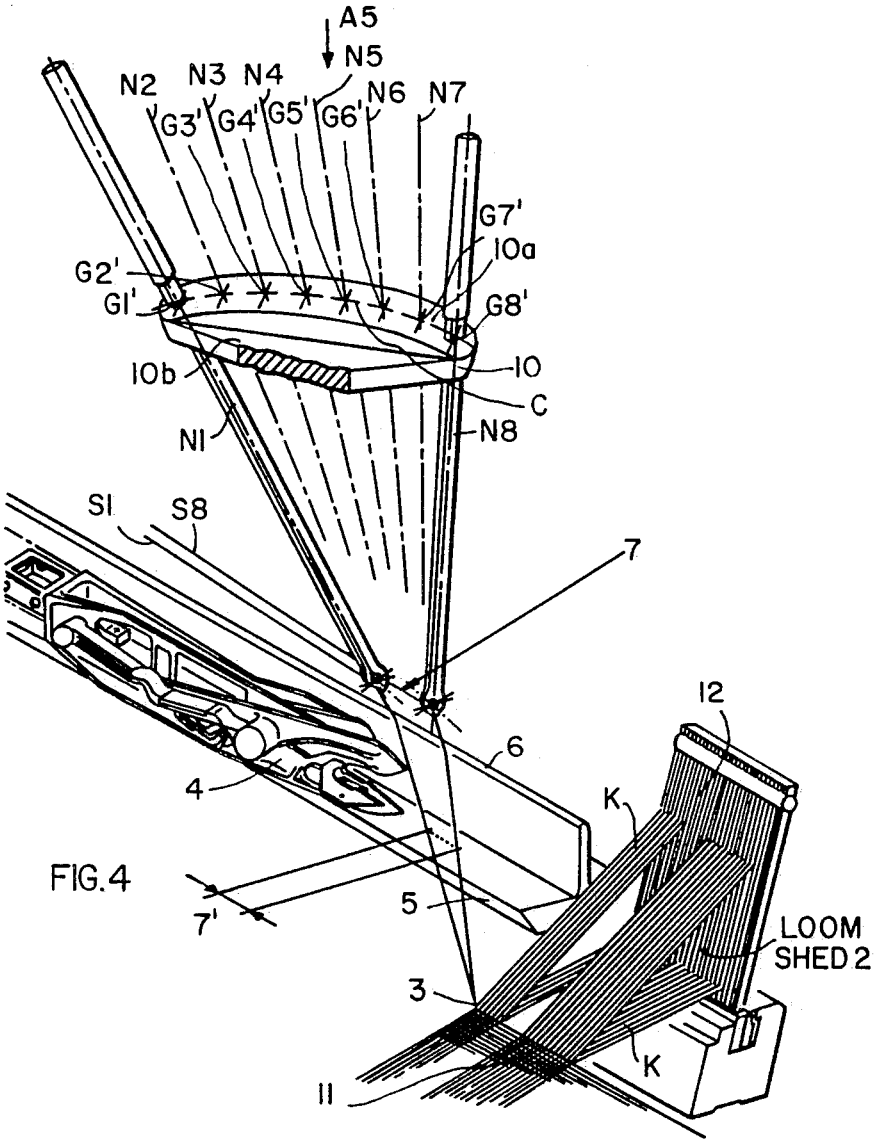
FIG. 4 is a perspective view partially broken away, but on an enlarged scale, illustrating the loom shed, a gripper with its guide rail, and the lower portion of a weft thread presenting needle fan in which the needles together define a plane twisted or curved in space.

FIG. 4 illustrates the presentation of two weft threads S1 and S8 at the moment just prior to seizing of the threads by the gripper head 4. At this moment the clamps of the gripper head 4 are opened by conventional means not shown. The gripper head 4 rests on the guide track 5 and is just behind, to the left, of the outermost weft thread S1. The paths of the threads S1 and S8 through the respective needle eyes over the rail 6 to the beating-up point or edge 3 are clearly shown and so is the spacing 7' between the two weft threads S1 and S8 where these threads intersect the path of the gripper 4. In this zone or spacing 7' the speed of the gripper head 4 is still small, whereby the weft thread S1 and even the last weft thread S8 is seized and clamped gently.

FIG. 4 shows the lower end of the needles N1 and N8. The other needles are merely shown by dashed lines. All the needles N1 to N8 are guided at their lower ends by the lower needle guides G1' to G8' in the guide carrier 10. The upper guide carrier 9 with its guides G1 to G8 is not shown in FIG. 4. Each of the lower needle guides G1' to G8' extends through the holder 10 at an individual slant, relative to the flat surface 10*b* of the guide carrier 10. However, the lower needle guides are located along a curve C in curved surface 10*a* of the lower guide carrier 10. Each guide has a guide hole with a rectangular cross-section through which the corresponding needle cross-section passes with a sliding fit. The rectangular cross-section makes sure that the needles cannot rotate and hence retain their relative position so that the needle eyes are always presented in the same orientation in their thread presenting or work position shown for needles N1 and N8 in FIG. 4.

Figure 5:
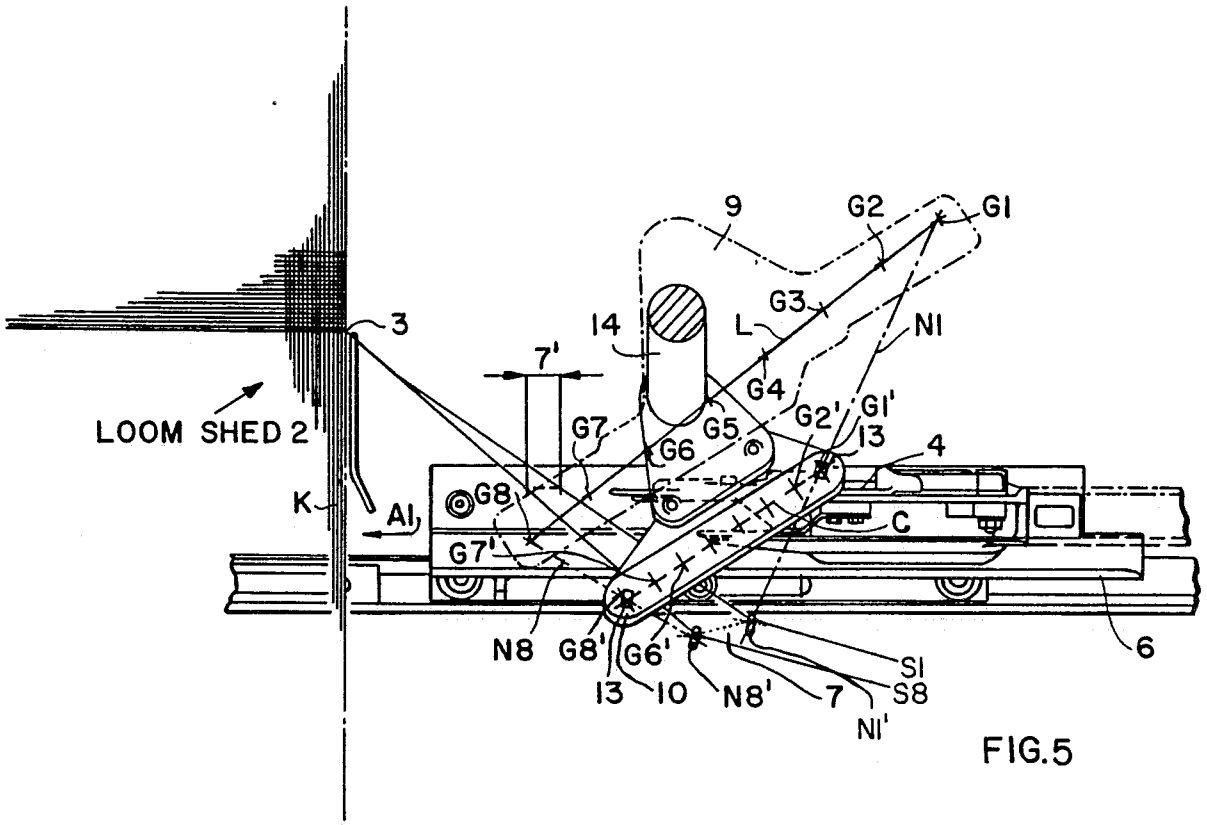
FIG. 5 is a view approximately in the direction of the arrow A5 in FIG. 4 and additionally showing in dash-dotted lines, a first needle guide holder.

The view of FIG. 5 in the direction of the arrow A5 in FIG. 4 additionally illustrates the needle guide carrier 9 in dash-dotted lines. In this presentation the curve C appears as a straight line rather than as a curve as in FIG. 4. The needle guides G1 to G8 in the guide carrier 9 extend along a line L. The guides G1 to G8 in guide carrier 9 and the guides G2' to G7' hold 10 are shown by intersections or little crosses. The guides G1' and G8' are shown as rectangles 13. The two needle guide carriers 9 and 10 are interconnected by a rod 14 such as a cylindrical rod. The needles N1 and N8 are shown by dash-dotted lines. The needle eyes N1' and N8' are shown at the ends of the dotted line 7 extending approximately in parallel to the path of the gripper head 4 or at a slight slant to the gripper path as shown in FIG. 5. The location of the line 7 is adjustable as will be described in more detail below. The spacing 7' between the crossing points of the gripper path with the presented weft threads S1 and S8 is shown in FIG. 5 and marked by a dotted line.

Figure 6:
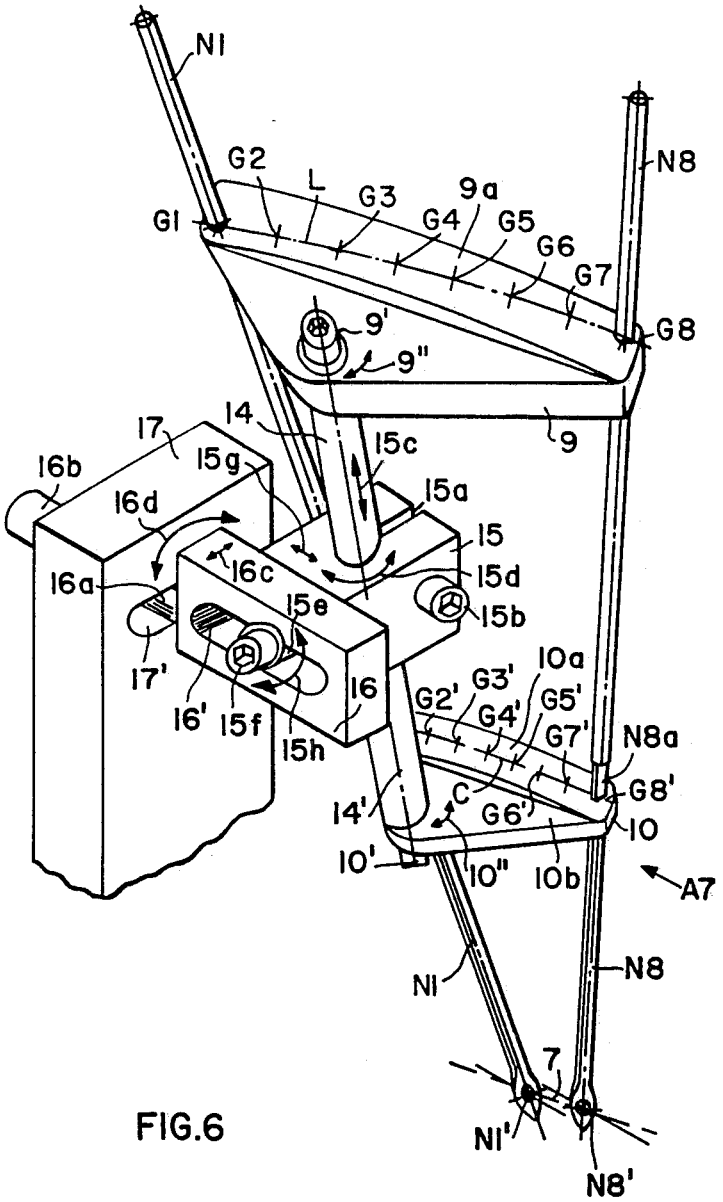
FIG. 6 is a simplified, perspective view of the thread presenting needle fan and the mounting and adjusting means for varying the position of the needle fan.

FIG. 6 illustrates the components used for making certain adjustments of the position of the fan-type surface or plane curved in space. As mentioned with reference to FIG. 5, the upper guide carrier 9 and the lower guide carrier 10 are adjustably interconnected by a cylindrical rod 14. FIG. 6 shows that the line L which interconnects the central axis of all needle guides G1 to G8, is curved in space since the portion 9a of guide carrier 9 is also curved. This is not visible in FIG. 5. The guide carrier 9 is connected to the upper end of the rod 14 by means of a threaded connection 9'. When the connection 9' is loosened, the guide carrier 9 can be rotated about the longitudinal axis 14' of the rod 14 as indicated by the arrow 9''. When the threaded connection 9' is tightened, the guide carrier 9 cannot be rotated relative to the rod 14. Similarly, the guide carrier 10 is secured to the lower end of the rod 14 by a threaded connection 10' permitting in its loosened state, the adjustment of the guide carrier 10 about the longitudinal axis 14' as indicated by the arrow 10''. When the threaded connection 10' is tightened, the guide carrier 10 cannot be rotated relative to the rod 14. The straight guides G1 to G8 in the guide carrier 9 and the straight guides G1' to G8' in the guide carrier 10 guide each of the needles N1 to N8 individually on a straight path. The two outer needles S1 and S8 are shown in the thread presenting position with the needle eyes N1' and N8' located on the line 7. Thus, the threads held by the needle eyes N1' and N8' can be inserted simultaneously into the shed. Each needle eye will take up a location along line 7 in its working position.

The connecting rod 14 is adjustably held in a first mounting block 15 having a slot 15*a* and a threaded member 15*b* for tightening the gap 15*a*, whereby the rod 14 is held in a fixed position. When the threaded member 15*b* is loosened, the rod 14 can be adjusted up and down as indicated by the arrow 15*c* and/or in a rotational direction as indicated by the arrow 15*d*. The mounting block 15 has a stud 15*e* passing through a longitudinal hole 16' of a second mounting block 16. Threaded member 15*f* provides a releasable connection of the stud 15*e* of the block 15 to the block 16. When the threaded member 15*f* is loosened, the block 15 can be moved back and forth as indicated by the arrow 15*g*. During this back and forth movement of the block 15, the stud 15*e* is guided in the hole 16'. Additionally, the block 15 may be turned about the longitudinal axis of the stud 15*e* as indicated by the arrow 15*h*. When the threaded member 15*f* is tightened, the block 15 is rigidly connected to the block 16.

The second mounting block 16 is adjustably connected to a third mounting block 17 in the same manner as the block 15 is connected to the block 16. More specifically, the block 16 has a mounting stud 16*a* extending through a longitudinal hole 17' of a third mounting block 17. A threaded member 16*b* on the free end of the stud 16*a* can be loosened for adjusting the position of the block 16 back and forth along the longitudinal hole 17' as indicated by the arrow 16*c* and rotationally as indicated by the arrow 16*d*. When the threaded member 16*b* is tightened, the block 16 is rigidly connected to the block 17 which in turn is rigidly connected to the machine frame not shown. At least the lower portions of the needles have a rectangular cross-sectional configuration as shown at N8*a*, for example, to prevent the above mentioned rotation of the needles about their longitudinal axes.

Adjustments indicated by the arrows 9'' and 10'' permit modifying the skew or twist of the plane curved in space formed by the needles N1 to N8. Adjustments indicated by the arrows 15*c*, 15*d*, 15*g*, 15*h*, and 16*c*, as well as 16*d*, permit the precise positioning of the line 7 relative to the path of the gripper 4. The described adjustments permit changing the angular relationship as well as the elevational relationship of the line 7 to the paths of the gripper 4. For adjusting the twist of the plane defined by the spacial needles, it may be necessary to provide the straight guides G1 to G8 and G1′ to G8′ in the form of self-adjusting members as will be described in more detail below with reference to FIG. 8.

Figure 7:
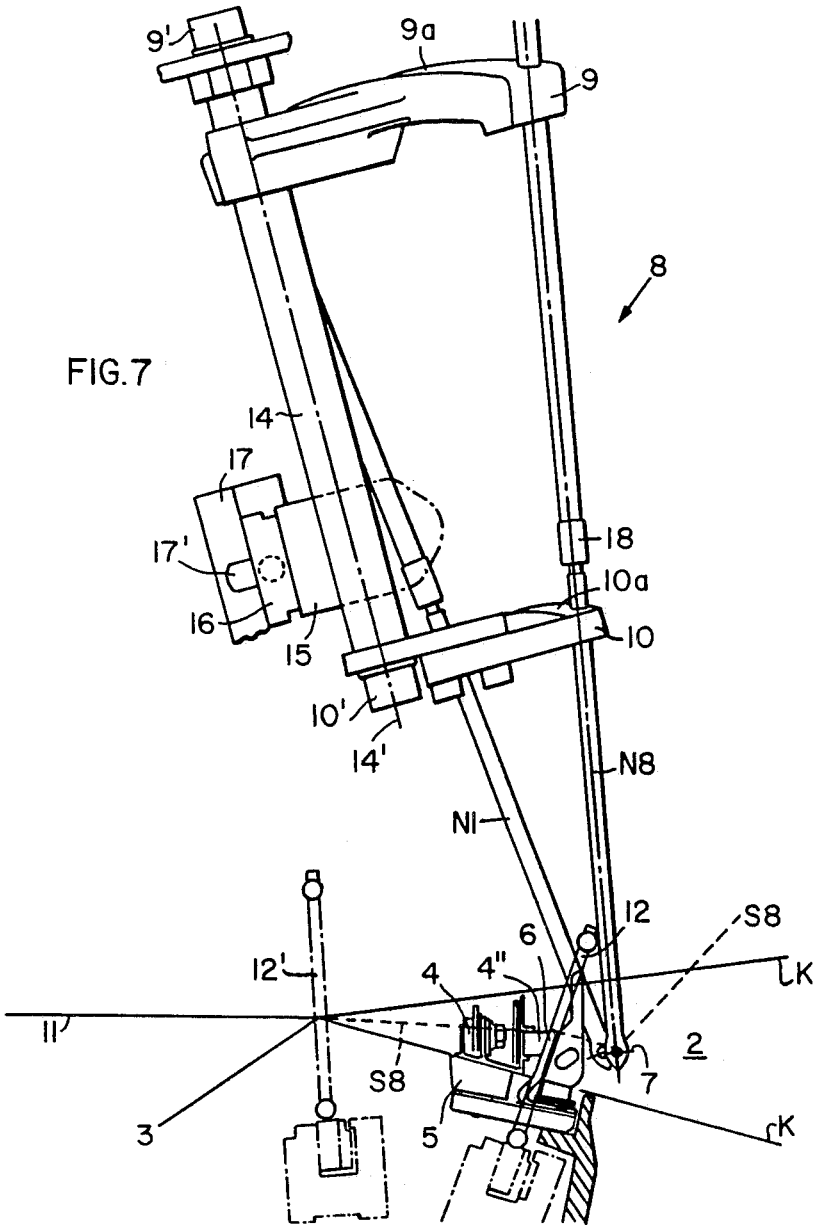
FIG. 7 is a view into the loom shed approximately in the direction of the arrow A7 in FIG. 6 showing the needle fan and its twisted location in space.

The view of FIG. 7 is in the direction of the arrow A7 in FIG. 6 and basically out of the loom shed 2 formed by the warp threads K. The reed 12 is shown in full lines in its rest position while its working position 12′ is shown by dash-dotted lines. The gripper 4 is still outside the shed 2 in a position ready to seize a weft thread, for example, the weft thread S8. The gripper 4 rests on its guide track 5 while also leaning against the rail 6 with a guide block 4″. The thread presenting device 8 is shown in FIG. 7 substantially with the same components as in FIG. 6, except certain reference numbers have not been repeated in FIG. 7. The portions 9*a*, 10*a*, of the guide carrier 9 and 10 which carry the needle straight guides G1 to G8 and G1′ to G8′ have a certain curvature which has the advantage that the longitudinal axes of the respective straight guides for the needles may extend at a right angle relative to the just mentioned curvatures 9*a*, 10*a*. This feature facilitates the drilling of the guide holes for the needle straight guides G1 to G8 and G1′ to G8′.

The needles N1 and N8 are shown in their thread presenting position with the respective needle eyes N1′ and N8′ on line 7 which defines the working position for all needle eyes according to the invention as explained above.

The needle eye N8′ of the needle N8 presents the weft thread S8, shown by a dashed line, into position for seizing by the gripper 4. The weft thread S8 extends from the beating-up point or edge 3 past the gripper 4 over the rail 6 through the eye N8′ of the needle N8 and then to a supply spool not shown. In this position the thread S8 is located directly in front of the gripper 4 at such an elevation that it may be directly seized by the gripper jaws not shown in FIG. 7. Since the gripper at this point has a very low speed, the thread is treated gently.

Each needle may be provided as two portions with threaded ends for cooperation with a threaded bushing 18 for interconnecting the two needle portions to change the effective length of the needles N1 to N8. This feature also contributes to adjusting the entire mechanism for presenting the needle eyes exactly along the line 7.

It has been explained above with reference to FIG. 6 that after loosening the screws 9′ or 10′ a rotation of the holder 9 or holder 10 about the axis 14′ is possible is the direction of the arrows 9″ or 10″. Thus, the direction of the line L for the row of the first straight guides G1 to G8 and the direction of the line C for the row of the second straight guides G1′ to G8′, are adjustable relative to each other, or the above mentioned angle $\alpha$ which is defined by these two directions, is variable. A variation of the angle $\alpha$ changes the twist of the needles N1 to N8 passing through the straight guides and forming the thread presenting device. Normally, these adaptations result only in small changes of the angle $\alpha$ and the bearing play of the needles in their straight guide hole can take up these displacements without any difficulties. However, if the changes of the angle $\alpha$ should become larger, the needles would start being jammed in their straight guide hole. In order to avoid this, it is possible to construct the straight guides G1 to G8 and G1′ to G8′ as self-adapting devices which are tiltably supported in the manner of a pivot. One possibility of such a self-adapting supporting of the straight guides is schematically shown in FIG. 8. In the left part of FIG. 8, there is shown the path of a presenting needle N8 without any twist while the right-hand side of FIG. 8 shows a twist due to a change of the angle $\alpha$. In the guide carrier 9 and in the guide carrier 10 the straight guides G8 or G8′ are constructed as a type of ball pivot, whereby the straight guide flanks of the needles 8 pass through a hole in the respective pivot ball or sphere. A pivot ball 19 is mounted for free rotation in the holder 9.

A ball 19′ is mounted for free rotation in the guide carrier 10. Such mountings are known and hence not shown in detail. Thus, the needle 8 passing through these balls can adjust itself when an inclination occurs.

The left-hand part of FIG. 8 assumes that the needle N8 passes at a right angle through the surface of the guide carrier 9 and guide carrier 10. The two pivot balls 19 or 19′ are thus located opposite one another in their holders. In the right-hand part of FIG. 8, it is assumed that the directions of the guide carriers 9 and 10 are twisted relative to each other by the angle $\alpha$. The arc of the angle $\alpha$ is shown for illustration. The two pivot balls 19 and 19′ are now no longer located exactly opposite one another, but are displaced relative to each other by the length of the arc above the angle $\alpha$. Due to their spherical shape, the straight pivot balls forming the guides G8 and G8′ can adapt themselves without difficulties to the changed slanted position of the needle 8 and the needles can be guided exactly without any jamming in any slanted position or for any twisting of the needle fan in space. The described embodiment of the self-adapting straight guides constitutes but one example. Other types of self-adapting or yieldingly supported straight guides may also be used.

Although the invention has been described with reference to specific example embodiments, it will be appreciated, that it is intended to cover all modifications and equivalents within the scope of the appended claims.

What we claim is:

1. An apparatus for presenting weft threads to a gripper in a shuttleless loom, comprising a plurality of weft thread presenting needles each having an eye for holding a weft thread, needle guide means for movably holding and guiding each of said needles, needle guide carrier means for said needle guide means, mounting means for securing said needle guide carrier means to said loom, said needle guide carrier means having a longitudinal axis extending at a slant to a gripper path and toward heald shafts of said loom, said needle guide means having longitudinal axes with a skew in space relative to each other for locating and guiding said weft thread presenting needles in a fan type plane twisted or curved in space so that said needle eyes assume thread presenting positions all of which are located close to each other on a straight line (7) extending approximately in parallel to said gripper path.

2. The apparatus of claim 1, wherein said needle guide means comprise pivoting needle guide members for adjusting said skew individually for each of said needle guide members so that the extent of said skew of any one of said needle guide members may be varied relative to the skew of any other needle guide members.

3. The apparatus of claim 1, wherein said mounting means for securing said needle guide carrier means to said loom comprise means for adjusting the position of said needle guide carrier means in space for obtaining said fan type plane twisted or curved in space.

4. The apparatus of claim 1, wherein at least certain of said weft thread presenting needles comprise two sections and means (18) adjustably interconnecting said two needle sections for adjusting a needle length.

5. The apparatus of claim 1, wherein said needle guide means comprise a first group of needle guides and a second group of needle guides, said needle guide carrier means comprising a first guide carrier (9) for holding said first group of needle guides and a second guide carrier (10) for holding said second group of needle guides, said first and second guide carriers (9, 10) being secured to said mounting means in such a way that said weft thread presenting needles are guided in their movement through said first and second group of needle guides in said fan type plane twisted or curved in space.

6. The apparatus of claim 5, further comprising means for adjusting an angular position of said first guide carrier (9) relative to an angular position of said second guide carrier and vice versa for modifying said fan type plane in its twist or curvature in space.

7. The apparatus of claim 5, further comprising means for adjusting said skew individually for said first group of said needle guides and for said second group of said needle guides, said adjusting means varying the direction of said longitudinal axes of said needle guides of said first and second group of needle guides relative to said first guide carrier and relative to said second guide carrier.

8. The apparatus of claim 5, wherein said needle guide carrier means further comprise a cylindrical rod (14), first means adjustably connecting said first holder (9) to one end of said rod, second means adjustably connecting said second holder (10) to the other end of said rod, a first mounting block (15) adjustably holding said rod, a second mounting block (16) adjustably holding said first mounting block, and a third mounting block forming part of said loom for adjustably holding said second mounting block, whereby a twisted or curved configuration of said fan type plane in space may be modified.

9. The apparatus of claim 8, wherein said first means for adjustably connecting said first guide carrier (9) to said cylindrical rod comprise first releasable means (9') for permitting a rotation of said first guide carrier (9) about a longitudinal axis (14') of said cylindrical rod (14), wherein said second means for adjustably connecting said second guide carrier to said cylindrical rod comprise second releasable means (10') for permitting rotation of said second guide carrier (10) about said longitudinal axis of cylindrical rod (14), wherein said first mounting block (15) has releasable clamping members (15*a*, 15*b*) for permitting a displacement of said cylindrical rod in the direction of said longitudinal axis and a rotation of said cylindrical rod about said longitudinal axis in a released state of said clamping members while preventing any displacement and rotation in a clamped state, said second mounting block (16) comprising a longitudinal slot (16'), said first mounting block (15) comprising a mounting stud (15*e*) extending displaceably and rotatably through said longitudinal slot and releasable means (15*e*) for clamping said first mounting block to said second mounting block, thereby preventing any displacement and rotation of said first mounting block (15) relative to said second mounting block (16), said third mounting block (17) having a further longitudinal slot (17'), said second mounting block having a further mounting stud (16*a*) extending through said further longitudinal slot (17') for displacing and rotating said second mounting block (16) relative to said third mounting block, said second mounting block having further releasable means (16*b*) for clamping said second mounting block (16) to said third mounting block (17) thereby preventing any displacement and rotation of said second mounting block (16) relative to said third mounting block.

* * * * *